US007945980B2

(12) United States Patent
Zylman

(10) Patent No.: US 7,945,980 B2
(45) Date of Patent: May 24, 2011

(54) BRIDGE DECK

(75) Inventor: Joseph Zylman, Battle Creek, MI (US)

(73) Assignee: Griswold Machine & Engineering, Inc., Union City, MI (US)

( * ) Notice: Subject to any disclaimer, the term of this patent is extended or adjusted under 35 U.S.C. 154(b) by 173 days.

(21) Appl. No.: 12/504,145

(22) Filed: Jul. 16, 2009

(65) Prior Publication Data

US 2010/0031458 A1 Feb. 11, 2010

Related U.S. Application Data

(60) Provisional application No. 61/086,328, filed on Aug. 5, 2008.

(51) Int. Cl.
*E01D 15/12* (2006.01)

(52) U.S. Cl. ..... 14/2.4; 14/73

(58) Field of Classification Search ..... 14/2.4, 14/73; 404/35; 294/901
See application file for complete search history.

(56) References Cited

U.S. PATENT DOCUMENTS

| | | | | | |
|---|---|---|---|---|---|
| 2,407,059 | A * | 9/1946 | Crafton | 404/35 |
| 2,886,370 | A * | 5/1959 | Liebert | 294/89 |
| 3,311,939 | A | 4/1967 | Yamamoto et al. | |
| 3,877,671 | A * | 4/1975 | Underwood et al. | 248/346.03 |
| 3,920,347 | A * | 11/1975 | Sauriol et al. | 404/25 |
| 4,974,992 | A * | 12/1990 | Harter | 404/25 |
| 5,467,493 | A | 11/1995 | Alten | |
| 5,713,695 | A | 2/1998 | Rogers | |
| 5,758,467 | A | 6/1998 | Snear et al. | |
| 5,863,148 | A * | 1/1999 | Shivaram | 404/28 |
| 5,924,152 | A * | 7/1999 | Maier | 14/2.4 |
| 6,231,267 | B1 | 5/2001 | Pearl | |
| 6,523,800 | B2 * | 2/2003 | Hsu | 248/499 |
| 7,427,172 | B2 * | 9/2008 | Lukasik | 404/36 |
| 7,608,313 | B2 * | 10/2009 | Solomon et al. | 428/60 |
| 2003/0235468 | A1 * | 12/2003 | Sproules | 404/34 |
| 2008/0292397 | A1 * | 11/2008 | Farney et al. | 404/32 |

* cited by examiner

*Primary Examiner* — Gary S Hartmann
(74) *Attorney, Agent, or Firm* — Dickinson Wright PLLC; Harold W. Milton, Jr.

(57) ABSTRACT

A bridge deck (20) includes a plurality of rows (72, 74) of tubes (44) each extending between tube ends (46) with the tubes (44) disposed adjacent to each other in a side by side relationship. The bridge deck (20) includes lifting blocks (60, 70) having a square periphery with equal block sides (58) disposed therein abutting one of the tube ends (46) of at least one of the tubes (44) and laterally engaging adjacent tubes (44) on either side of the one tube (44). The rows (72, 74) include block rows (72, 74) defining two tubes (44) abutting one of the block sides (58) of one of the lifting blocks (60, 70). The block rows (72, 74) include end-block rows (74) having one of the tubes (44) abutting one of the block sides (58) of one of the lifting blocks (60, 70) at each tube end (46) thereof. The block rows (72, 74) include mid-block rows (72) having two tubes (44) abutting opposite block sides (58) of one of the lifting blocks (60, 70). The lifting blocks (60, 70) include lug lifting blocks (60) and hoist lifting blocks (70).

22 Claims, 2 Drawing Sheets

$W_T$
$H_T$
$P_U$
$P_L$
3
3

BRIDGE DECK

CROSS REFERENCE TO RELATED APPLICATION

This application claims the benefit of provisional application Ser. No. 61/086,328 filed Aug. 5, 2008.

BACKGROUND OF THE INVENTION

1. Field of the Invention

The subject invention relates to a bridge deck of the type for covering holes in streets and to bridge trenches.

2. Description of the Prior Art

The prior art discloses such bridge decks for temporary traversal of a trench or chasm. These bridge decks are removable for use at subsequent installations and must support the traversal of construction equipment passing thereon. The U.S. Pat. No. 5,713,695 (Rogers) discloses a bridge deck having a lifting block disposed therein. The U.S. Pat. No. 5,467,493 (Alten) discloses a plurality of tubes each extending between tube ends and surrounding an open space with a plurality of rows of the tubes disposed in a side by side relationship.

SUMMARY OF THE INVENTION

The invention provides for at least one lifting block abutting one of the tube ends of at least one of the tubes and laterally engaging adjacent tubes on either side of the one tube.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figures 1, 2:
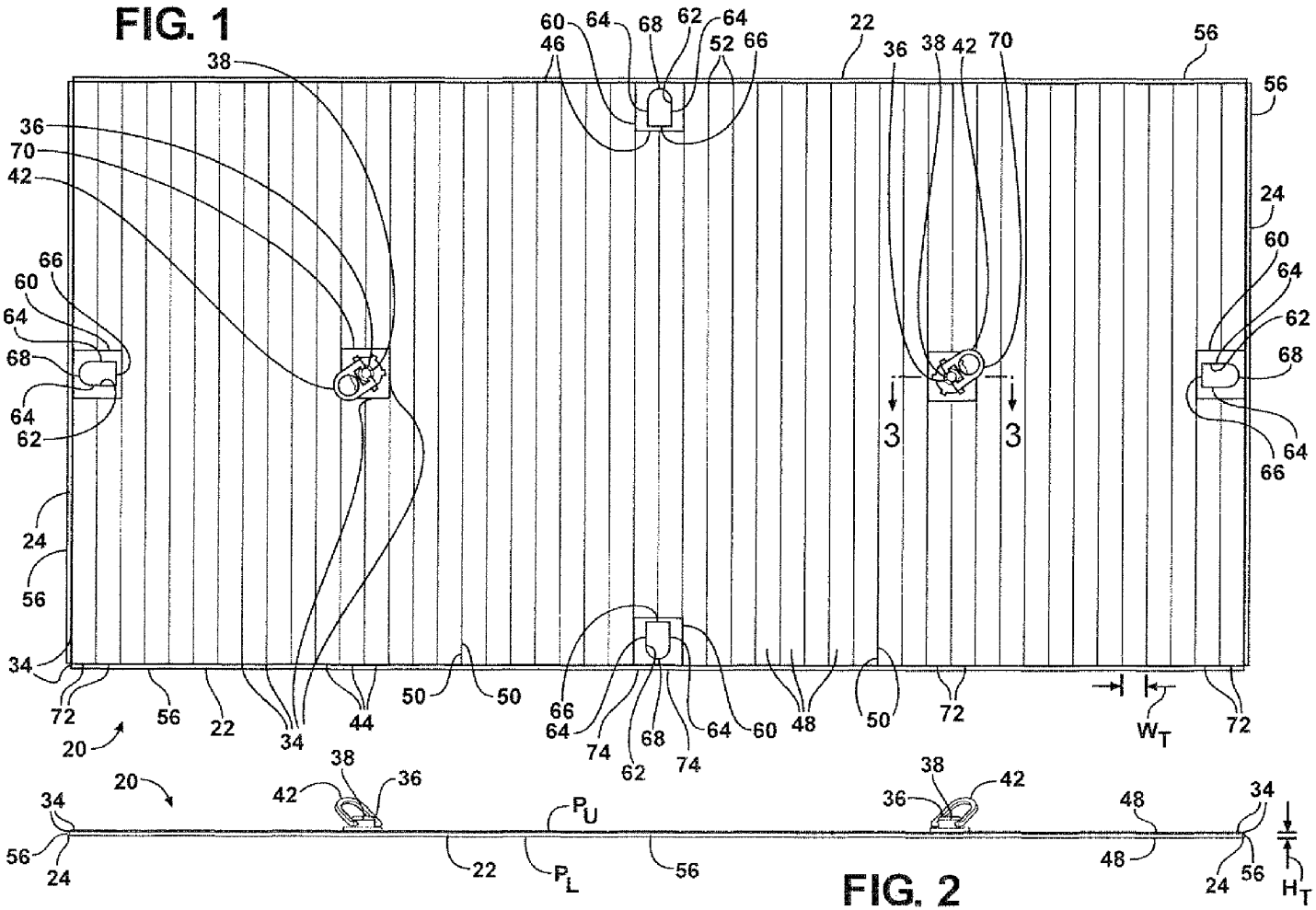
FIG. 1 is a plan view of a bridge deck in accordance with the subject invention.
FIG. 2 is a front view of a bridge deck in accordance with the subject invention.
Figure 3:
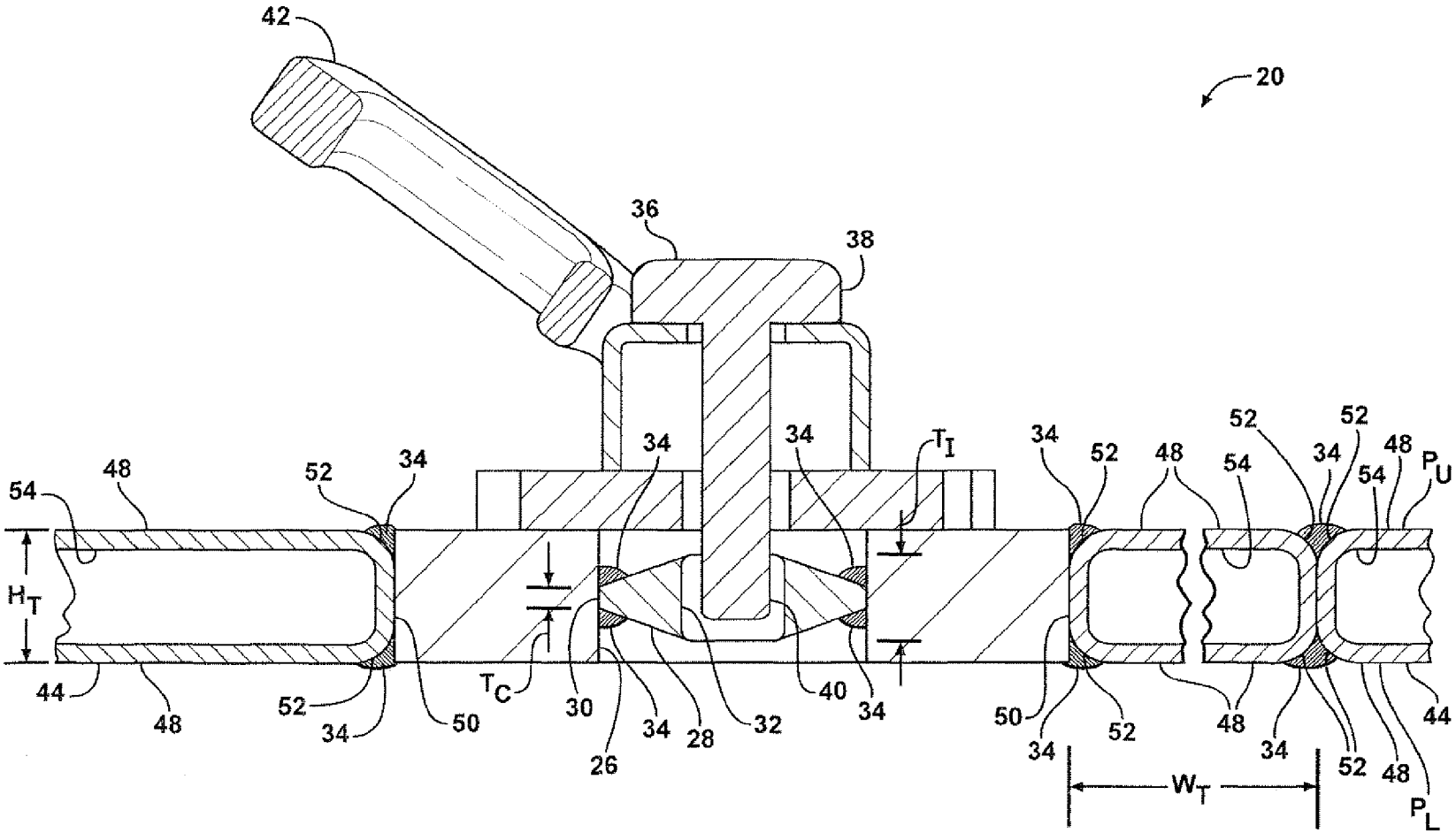
FIG. 3 is an enlarged fragmentary cross-sectional view taken along line 3-3 of FIG. 1.

Referring to the Figures, wherein like numerals indicate corresponding parts throughout the several views, a bridge deck has a deck periphery 22, 24 defined by deck sides 22 and deck ends 24. The bridge deck 20 defines an upper plane $P_U$ and a lower plane $P_L$ parallel to the upper plane $P_U$. The bridge deck 20 defines a plug hole 26 which is round and extends therethrough perpendicular to the planes $P_L$, $P_U$.

A plug 28, being metal, defines a circumferential edge 30 and is disposed in and engages the plug hole 26. The plug 28 defines a threaded hole 32, and the threaded hole 32 is threaded and extends therethrough. The plug 28 presents a circumferential thickness $T_C$ at the circumferential edge 30 and an inner thickness $T_I$ adjacent the threaded hole 32 that is greater than the circumferential thickness $T_C$. Weld material 34 is adjacent the circumferential edge 30 and the plug hole 26 to secure the plug 28 to the bridge deck 20. A bolt 36 has a head 38 and a threaded end 40. The threaded end 40 is threaded and opposite of the head 38 and is disposed in and engages the threaded hole 32. A hoist ring 42 is attached to the head 38 of the bolt 36. The hoist ring 42 is for lifting and moving the bridge deck 20.

The bridge deck 20 includes a plurality of tubes 44 and each tube 44 is metal and extends between tube ends 46. Each tube 44 has a pair of horizontal sides 48, and each horizontal side 48 is flat and co-planar with one of the planes $P_L$, $P_U$. The normal distance between the horizontal sides 48 define a tube height $H_T$. Each tube 44 has a pair of vertical sides 50, and each vertical side 50 is flat and perpendicular to the horizontal sides 48. The normal distance between the vertical sides 50 defines a tube width $W_T$. The tube width $W_T$ is greater than the tube height $H_T$. Outer corners 52 are rounded and join the horizontal sides 48 to the vertical sides 50. The horizontal sides 48, the vertical sides 50, and the outer corners 52 surround an open space 54. The open space 54 is rectangular and extends through the tube 44 between the tube ends 46 thereof.

The tubes 44 are disposed in a plurality of rows 72, 74 in a side by side relationship, and each row 72, 74 extends between the deck sides 22. A strip 56 is metal and extends between the planes $P_L$, $P_U$ and along each of the deck ends 24 and the deck sides 22 to cover the open spaces 54 of the tubes 44 thereat. The strip 56 could be continuous or include multiple strips 56 in end to end relationship, e.g., welded together at the corners.

The bridge deck 20 has at least one lifting block 60, 70 disposed therein. Each lifting block 60, 70 is metal and a square cuboid having a square periphery with equal block sides 58. Each block side 58 is twice the tube width $W_T$. Each lifting block 60, 70 extends between and is co-planar with the upper plane $P_U$ and the lower plane $P_L$. Weld material 34 secures adjacent rows 72, 74 to each other and to the strips 56 and the lifting blocks 60, 70.

The bridge deck 20 is characterized by at least one of the lifting blocks 60, 70 abutting one of the tube ends 46 of at least one of the tubes 44 and laterally engaging the tubes 44 on either side of the one tube 44.

The lifting blocks 60, 70 include a plurality of lug lifting blocks 60, each of which defines a through-hole 62 extending therethrough perpendicular to the planes $P_L$, $P_U$. The lug lifting block 60 has a pair of parallel sides 64. The parallel sides 64 are parallel to each other. The lug lifting block 60 includes a perpendicular side 66 connecting and perpendicular to the parallel sides 64. An arcuate side 68 is opposite the perpendicular side 66 and connects the parallel sides 64 and arches away from the perpendicular side 66. The lug lifting blocks 60 are used to lift the bridge deck 20, either manually or by equipment. The through-holes 62 may also be used to anchor the bridge deck 20.

The lifting blocks 60, 70 including a plurality of hoist lifting blocks 70 each of which defines the plug hole 26 and the plug hole 26 is perpendicular to the planes $P_L$, $P_U$. Accordingly, each hoist lifting block 70 supports a plug 28 for lifting the bridge deck 20.

The rows 72, 74 of tubes 44 include a plurality of block rows 72, 74 defining two tubes 44 abutting one of the block sides 58 of one of the lifting blocks 60, 70. The block rows 72, 74 include a plurality of mid-block rows 72 with each mid-block row 72 having two of the tubes 44 abutting opposite ones of the block sides 58 of one of the lifting blocks 60, 70. The block rows 72, 74 include a plurality of end-block rows 74 with each end-block row 74 having one of the tubes 44 abutting one of the block sides 58 of one of the lifting blocks 60, 70 at each tube end 46 thereof.

A plurality of the hoist lifting blocks 70 are disposed in the mid-block rows 72 inwardly of the deck periphery 22, 24. In the preferred embodiment, the hoist lifting blocks 70 are disposed midway between the deck sides 22. A plurality of the lug lifting blocks 60 are disposed along the deck sides 22 and the deck ends 24 of the bridge deck 20 and in contact with the strip 56. In the preferred embodiment, the lug lifting blocks 60 are disposed along the deck sides 22 midway between the deck ends 24 or along the deck ends 24 midway between the deck sides 22. Weld material 34 secures the lifting blocks 60, 70 disposed along the deck sides 22 and the deck ends 24 to the strip 56.

Obviously, many modifications and variations of the present invention are possible in light of the above teachings and may be practiced otherwise than as specifically described while within the scope of the appended claims. That which is prior art in the claims precedes the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the inventive novelty exercises its utility. The use of the word "the" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

ELEMENT LIST

| Element Symbol | Element Name |
|---|---|
| 20 | deck |
| 22 | deck sides |
| 22, 24 | deck periphery |
| 24 | deck ends |
| 26 | plug hole |
| 28 | plug |
| 30 | circumferential edge |
| 32 | threaded hole |
| 34 | Weld material |
| 36 | bolt |
| 38 | head |
| 40 | threaded end |
| 42 | hoist ring |
| 44 | tube |
| 46 | tube ends |
| 48 | horizontal sides |
| 50 | vertical sides |
| 52 | Outer corners |
| 54 | open spaces |
| 56 | strip |
| 58 | block sides |
| 60 | lug lifting block |
| 60, 70 | lifting block |
| 62 | through-hole |
| 64 | parallel sides |
| 66 | perpendicular side |
| 68 | arcuate side |
| 70 | hoist lifting block |
| 72 | mid-block row |
| 72, 74 | rows |
| 74 | end-block row |
| $H_T$ | tube height |
| $P_L$ | lower plane |
| $P_U$ | upper plane |
| $T_C$ | circumferential thickness |
| $T_I$ | inner thickness |
| $W_T$ | tube width |

What is claimed is:

1. A bridge deck (20) comprising;

a plurality of tubes (44) each extending between tube ends (46) and presenting a tube width ($W_T$) and surrounding an open space (54), said tubes (44) disposed in a plurality of rows (72, 74) in a side by side relationship, said bridge deck (20) having at least one lifting block (60, 70) disposed therein, and characterized by at least one said lifting block (60, 70) abutting one of said tube ends (46) of at least one of said tubes (44) and laterally engaging said tubes (44) on either side of said one tube (44).

2. A bridge deck (20) as set forth in claim 1 wherein said bridge deck (20) defines an upper plane ($P_U$) and a lower plane ($P_L$) parallel to said upper plane ($P_U$) and said lifting blocks (60, 70) extend between and are co-planar with said upper plane ($P_U$) and said lower plane ($P_L$).

3. A bridge deck (20) as set forth in claim 2 wherein each of said lifting blocks (60, 70) has four block sides (58) and at least two block sides (58) being twice said tube width ($W_T$).

4. A bridge deck (20) as set forth in claim 3 wherein said lifting block (60, 70) extends between and is co-planar with said upper plane ($P_U$) and said lower plane ($P_L$).

5. A bridge deck (20) as set forth in claim 3 wherein each of said lifting blocks (60, 70) is a square cuboid having a square periphery defining equal said block sides (58).

6. A bridge deck (20) as set forth in claim 3 wherein said rows (72, 74) include a plurality of block rows (72, 74) defining two of said tubes (44) abutting one of said block sides (58) of one of said lifting blocks (60, 70).

7. A bridge deck (20) as set forth in claim 3 wherein said rows (72, 74) include a plurality of mid-block rows (72) with each of said mid-block row (72) having two of said tubes (44) abutting opposite ones of said block sides (58) of one of said lifting blocks (60, 70).

8. A bridge deck (20) as set forth in claim 3 wherein said rows (72, 74) include a plurality of end-block rows (74) with each said end-block row (74) having one of said tubes (44) abutting one of said block sides (58) of one of said lifting blocks (60, 70) at each tube end (46) thereof.

9. A bridge deck (20) as set forth in claim 2 wherein said bridge deck (20) has a deck periphery (22, 24) defined by deck sides (22) and deck ends (24).

10. A bridge deck (20) as set forth in claim 9 wherein a plurality of said lifting blocks (60, 70) are disposed along said deck sides (22) and said deck ends (24) of said bridge deck (20).

11. A bridge deck (20) as set forth in claim 9 wherein a plurality of said lifting blocks (60, 70) are disposed inwardly of said deck periphery (22, 24).

12. A bridge deck (20) as set forth in claim 2 wherein said lifting blocks (60, 70) include a lug lifting block (60) defining a through-hole (62) extending therethrough perpendicular to said planes ($P_L$, $P_U$) and having a pair of parallel sides (64) being parallel to each other and a perpendicular side (66) connecting and perpendicular to said parallel sides (64) and an arcuate side (68) opposite said perpendicular side (66) and connecting said parallel sides (64) and arching away from said perpendicular side (66).

13. A bridge deck (20) as set forth in claim 2 wherein said lifting blocks (60, 70) include a hoist lifting block (70) defining a plug hole (26) being round and extending therethrough perpendicular to said planes ($P_L$, $P_U$).

14. A bridge deck (20) as set forth in claim 13 wherein said hoist lifting bock (70) is metal, and said bridge deck (20) includes a plug (28) being metal and defining a circumferential edge (30) and disposed in and engaging said plug hole (26) and defining a threaded hole (32) being threaded and extending therethrough and said plug (28) presenting a circumferential thickness ($T_C$) at said circumferential edge (30) and an inner thickness ($T_I$) adjacent said threaded hole (32) being greater than said circumferential thickness ($T_C$), and weld material (34) adjacent said circumferential edge (30) and said plug hole (26) to secure said plug (28) to said bridge deck (20), and a bolt (36) having a head (38) and a threaded end (40) being threaded and opposite of said head (38) and disposed in and engaging said threaded hole (32), and a hoist ring (42) attached to said head (38) of said bolt (36).

15. A bridge deck (20) as set forth in claim 9 including a strip (56) extending between said planes ($P_L$, $P_U$) and along each of said deck ends (24) and said deck sides (22) to cover said open spaces (54) of said tubes (44) thereat, and said lifting blocks (60, 70) disposed along said deck sides (22) and said deck ends (24) are in contact with said strip (56).

16. A bridge deck (20) as set forth in claim 15 wherein each of said tubes (44) and said lifting blocks and said strips are metal, and including a weld material (34) securing adjacent said rows (72, 74) to each other and to said strips (56) and to said lifting blocks (60, 70), and securing said lifting blocks (60, 70) disposed along said deck sides (22) and said deck ends (24) to said strip (56).

17. A bridge deck (20) as set forth in claim 3 wherein said tubes (44) have a pair of horizontal sides (48) each being flat and co-planar with one of said planes ($P_L$, $P_U$) and the normal distance between said horizontal sides (48) defining a tube height ($H_T$) and a pair of vertical sides (50) each being flat and perpendicular to said horizontal sides (48) and the normal distance between said vertical sides (50) defining said tube width ($W_T$) being greater than said tube height ($H_T$) and outer corners (52) being rounded and joining said horizontal sides (48) to said vertical sides (50) and each of said horizontal sides (48) and said vertical sides (50) and said outer corners (52) surrounding said open space (54) being rectangular and extending through said tube (44) between said tube ends (46) thereof.

18. A bridge deck (20) as set forth in claim 9 wherein each said row (72, 74) extends between said deck ends (24), and the normal distance between said deck ends (24) is greater than the normal distance between said deck sides (22).

19. A bridge deck (20) as set forth in claim 9 wherein each said row (72, 74) extends between said deck ends (24), and the normal distance between said deck ends (24) is less than the normal distance between said deck sides (22).

20. A bridge deck (20) comprising;

a deck periphery (22, 24) defined by deck sides (22) and deck ends (24) with said bridge deck (20) defining an upper plane ($P_U$) and a lower plane ($P_L$) parallel to said upper plane ($P_U$) and defining a plug hole (26) being round and extending therethrough and perpendicular to said planes ($P_L$, $P_U$), a plug (28) being metal and defining a circumferential edge (30) and disposed in and engaging said plug hole (26) and defining a threaded hole (32) being threaded and extending therethrough and said plug (28) presenting a circumferential thickness ($T_C$) at said circumferential edge (30) and an inner thickness ($T_I$) adjacent said threaded hole (32) being greater than said circumferential thickness ($T_C$), weld material (34) being adjacent said circumferential edge (30) and said plug hole (26) to secure said plug (28) to said bridge deck (20), a bolt (36) having a head (38) and a threaded end (40) being threaded and opposite of said head (38) and disposed in and engaging said threaded hole (32), a hoist ring (42) attached to said head (38) of said bolt (36), said bridge deck (20) including a plurality of tubes (44) each being metal and extending between tube ends (46) and having a pair of horizontal sides (48) each being flat and co-planar with one of said planes ($P_L$, $P_U$) and the normal distance between said horizontal sides (48) defining a tube height ($H_T$) and a pair of vertical sides (50) each being flat and perpendicular to said horizontal sides (48) and the normal distance between said vertical sides (50) being greater than said tube height ($H_T$) and outer corners (52) being rounded and joining said horizontal sides (48) to said vertical sides (50) and each of said horizontal sides (48) and said vertical sides (50) and said outer corners (52) surrounding an open space (54) being rectangular and extending through said tube (44) between said tube ends (46) thereof, said tubes (44) disposed in a plurality of rows (72, 74) in a side by side relationship with each said row (72, 74) extending between said deck sides (22), a strip (56) being metal and extending between said planes ($P_L$, $P_U$) and along each of said deck ends (24) and said deck sides (22) to cover said open spaces (54) of said tubes (44) thereat, said bridge deck (20) having a lifting block (60, 70) disposed therein being metal and a square cuboid having a square periphery with equal block sides (58) with each said block side (58) being twice said tube width ($W_T$) with said lifting block (60, 70) extending between and co-planar with said upper plane ($P_U$) and said lower plane ($P_L$), weld material (34) securing adjacent said rows (72, 74) to each other and to said strips (56) and said lifting blocks (60, 70), characterized by at least one said lifting block (60, 70) abutting one of said tube ends (46) of at least one of said tubes (44) and laterally engaging said tubes (44) on either said of said one tube (44), said lifting blocks (60, 70) including a lug lifting block (60) defining a through-hole (62) extending therethrough perpendicular to said planes ($P_L$, $P_U$) and having a pair of parallel sides (64) being parallel to each other and a perpendicular side (66) connecting and perpendicular to said parallel sides (64) and an arcuate side (68) opposite said perpendicular side (66) and connecting said parallel sides (64) and arching away from said perpendicular side (66), said lifting blocks (60, 70) including a hoist lifting block (70) defining said plug hole (26) and said plug hole (26) being perpendicular to said planes ($P_L$, $P_U$), said rows (72, 74) including a plurality of block rows (72, 74) defining two said tubes (44) abutting one of said block sides (58) of one of said lifting blocks (60, 70), said block rows (72, 74) including a plurality of mid-block rows (72) with each said mid-block row (72) having two of said tubes (44) abutting opposite ones of said block sides (58) of one of said lifting blocks (60, 70), said block rows (72, 74) including a plurality of end-block rows (74) with each said end-block row (74) having one of said tubes (44) abutting one of said block sides (58) of one of said lifting blocks (60, 70) at each tube end (46) thereof, a plurality of said hoist lifting blocks (70) disposed in said mid-block rows (72) inwardly of said deck periphery (22, 24), a plurality of said lug lifting blocks (60) being disposed along said deck sides (22) and said deck ends (24) of said deck (20) and in contact with said strip (56), and weld material (34) securing said lifting blocks (60, 70) disposed along said deck sides (22) and said deck ends (24) to said strips (56).

21. A bridge deck (20) as set forth in claim 20 wherein the normal distance between said deck ends (24) is greater than the normal distance between said deck sides (22).

22. A bridge deck (20) as set forth in claim 20 wherein the normal distance between said deck ends (24) is less than the normal distance between said deck sides (22).

* * * * *